US005104124A

United States Patent [19]

Bernard et al.

[11] Patent Number: 5,104,124

[45] Date of Patent: Apr. 14, 1992

[54] COLLAPSIBLE GAME USABLE AS A PROMOTIONAL DEVICE

[75] Inventors: Stuart N. Bernard, Anoka, Minn.; Sanford K. Otsuji, Mission Viejo; David J. Rosendale, Torrance, both of Calif.

[73] Assignee: General Mills, Inc., Minneapolis, Minn.

[21] Appl. No.: 627,791

[22] Filed: Dec. 14, 1990

[51] Int. Cl.[5] ..... A63F 7/00

[52] U.S. Cl. ..... 273/85 F; 446/148; 446/487; 273/129 R; 273/119 R; 40/124.1

[58] Field of Search ..... 273/85 R, 85 C, 85 D, 273/85 E, 85 F, 340, 94, 400-410, 1.5 R, 336, 337, 129 R, 129 W, 118 R, 119 R, 126 R, 355; 40/312, 313, 530, 539, 124.1; 446/147-152, 487, 488; 206/618

[56] References Cited

U.S. PATENT DOCUMENTS

| | | | |
|---|---|---|---|
| 406,342 | 7/1889 | Dumont | 273/402 |
| 1,176,640 | 3/1916 | Barber | 206/618 |
| 1,341,628 | 6/1920 | Bourne | 273/402 X |
| 1,439,199 | 12/1922 | Spilman | 273/85 E |
| 1,954,838 | 4/1934 | Woolsey et al. | 273/94 R |
| 2,139,024 | 12/1938 | Kolm | 273/85 E X |
| 2,424,016 | 7/1947 | Botts | 273/405 X |
| 2,757,468 | 8/1956 | Cain | 40/539 X |
| 3,090,144 | 5/1963 | Malamude | 40/124.1 |
| 3,596,908 | 8/1971 | Long | 273/85 C |
| 3,622,160 | 11/1971 | Barfield | 273/85 C X |
| 3,703,291 | 9/1971 | Lutz | 273/85 R |
| 3,899,173 | 8/1975 | Zaris | 273/405 X |
| 4,949,482 | 8/1990 | Price | 40/124.1 |

FOREIGN PATENT DOCUMENTS

| | | | |
|---|---|---|---|
| 2372094 | 7/1978 | France | 206/618 |

*Primary Examiner*—Benjamin Layno
*Assistant Examiner*—Sebastiano Passaniti
*Attorney, Agent, or Firm*—L. MeRoy Lillehaugen; John A. O'Toole

[57] ABSTRACT

A collapsible game (10) is disclosed having the rear face (20) of a first panel (14) secured to the back of a box (12) or like product. A second panel (16) is integrally formed and pivotal about the bottom edge (18) of the first panel (14) between a first, abutting position and a second, angular position. The panels (14, 16) are formed of paper stock with the box (12) and the support surface upon which the box (12) is placed providing external support for the panels (14, 16). A goal (48) is simultaneously pivotal with the panels (14, 16) between a first, flat condition intermediate the panels (14, 16) in the first position and a second condition with the goal (48) three dimensionally spaced from the panels (14, 16) in the second position. The goal (48) is integrally formed from a single blank and is planar in the flat condition. The panels (14, 16) are releasably held in the abutting position by side and top flaps (40, 44) integrally formed with the panels (14, 16) when the game is in its manufactured, collapsed, one-piece condition. The panels (14, 16) are releasably held and removably fastened in the abutting position by a tab (106) and a slot (108) die cut in the panels (14, 16) after the flaps (40, 44) have been released.

23 Claims, 3 Drawing Sheets

COLLAPSIBLE GAME USABLE AS A PROMOTIONAL DEVICE

BACKGROUND

The present invention generally relates to games, particularly relates to collapsible games, and specifically relates to collapsible games for use as a promotional device in the sale of products such as cereal boxes to which such games are secured.

Due to the fierce competition in the marketing of breakfast cereals, it is the practice of many cereal manufacturers to include a premium with the cereal to promote the sale of the cereal beyond the marketability of the cereal itself. It can certainly be appreciated that such promotional devices must meet several requirements. First, as such devices are typically given away with the product, such devices must be relatively inexpensive to manufacture. Additionally, such devices must have the ability to be easily included with the product without disruption of the normal handling of such product. Thus, it is desirable that the promotional device be includable with the product without requiring different boxes, cartons, or the like, which would increase the cost of product production. Similarly, the promotional device should not require special handling or care by the manufacturer and retailer of the product beyond that normally given the product without the promotional device. But most important, the promotional device should have consumer appeal to maximize the promotional value of the device.

Prior promotional devices include items like coupons or the like which are printed on the boxes of the product or which are placed with the product in the boxes of the product, toys and other novelty items which are placed in the boxes of the product, and the like.

It is thus an object of the present invention to provide a game which can be collapsed to a small size, with the game being especially adaptable for use as a promotional device in the sale of a product, and especially cereal.

Yet another object of the present invention is to provide such a game which has a great play value, and particularly of the type having an athletic or sport type theme. In this regard, it is desirable to have the game be an integral part of the product such that the game is played in close proximity of the product to promote its consumption.

It is still further an object of the present invention to provide a promotional device which is manufactured separate from and independently of the product and then secured to the product which has been completed in the normal manner. Further, it is an aim of the present invention that the product with the promotional device secured thereto can be handled relatively in the normal manner as the product would have been handled if the promotional device was not secured thereto.

Yet another object of the present invention is to provide a promotional device which is relatively easy and inexpensive to manufacture and secure to the product. In this regard, such features are important in commmercializing the promotional device as the promotional device can be readily given away with the product without adversely affecting the profitability of the product.

SUMMARY

Surprisingly, the above objects and aims can be satisfied in the field of promotional devices and games by providing, in a first aspect of the preferred form of the present invention, a promotional device including first and second panels pivotable about a panel axis and which can be releasably held without the use of separate components in an abutting position. A movable structure is simultaneously pivotal with the panels between a first, flat condition intermediate the panels in their abutting position and a second condition with the movable structure being three dimensionally spaced from the panels in their angular position. The panels are formed of paper or like material which require external support, with the first panel being secured to a product which provides support thereto.

In a further aspect of the preferred form of the present invention, a collapsible game is provided including a goal which is simultaneously pivotal with first and second, pivotal panels. The goal includes integral stand, goal, and spacer portions which are pivotally mounted to each other to be planar in a first condition when the panels are in an abutting position and three dimensionally spaced from the panels when the panels extend at an angle from each other.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
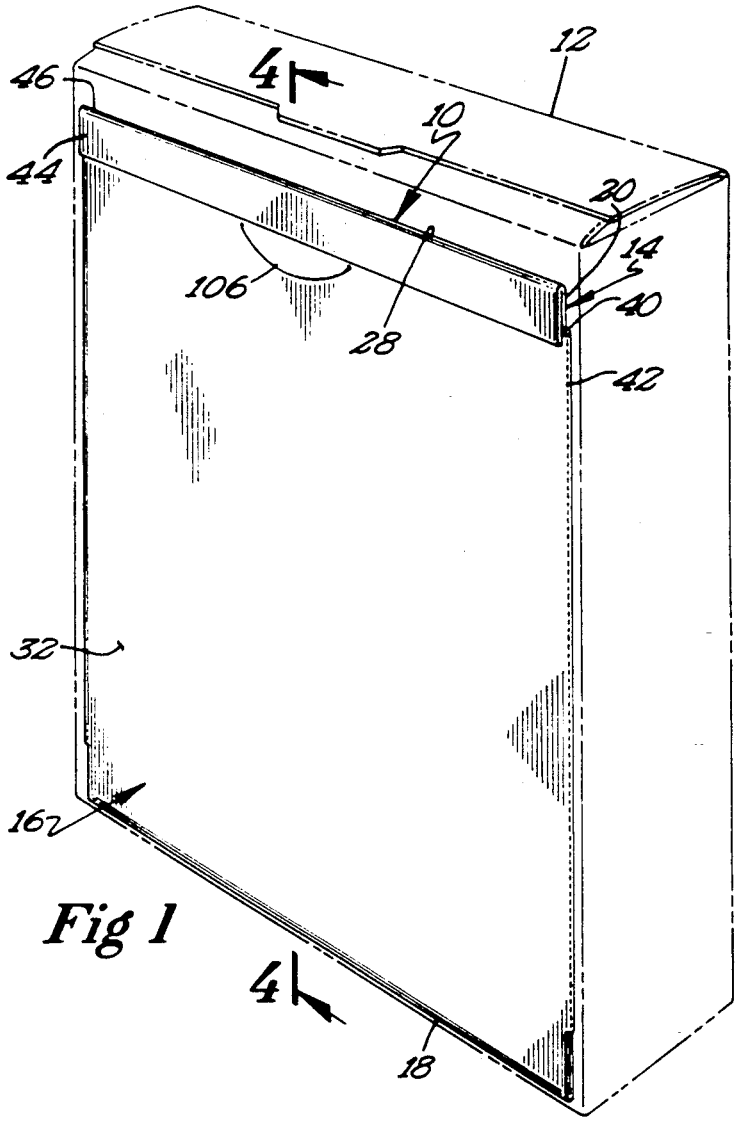
FIG. 1 shows a perspective view of a game in a collapsed, one-piece condition secured to a box according to the preferred teachings of the present invention, with the box shown in phantom.
Figure 5:
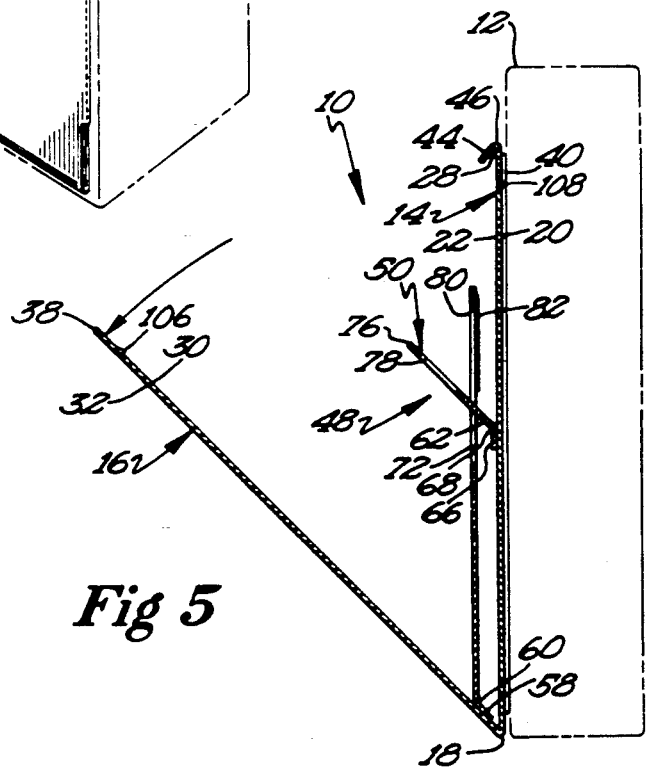
FIG. 5 shows a cross-sectional view of the game of FIG. 1 in a position intermediate the positions shown in FIGS. 1 and 2.
Figure 4:
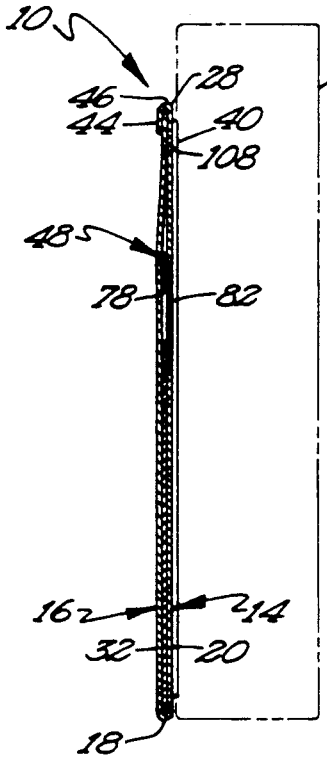
FIG. 4 shows a cross-sectional view of the game of FIG. 1 according to section line 4—4 of FIG. 1.
Figure 2:
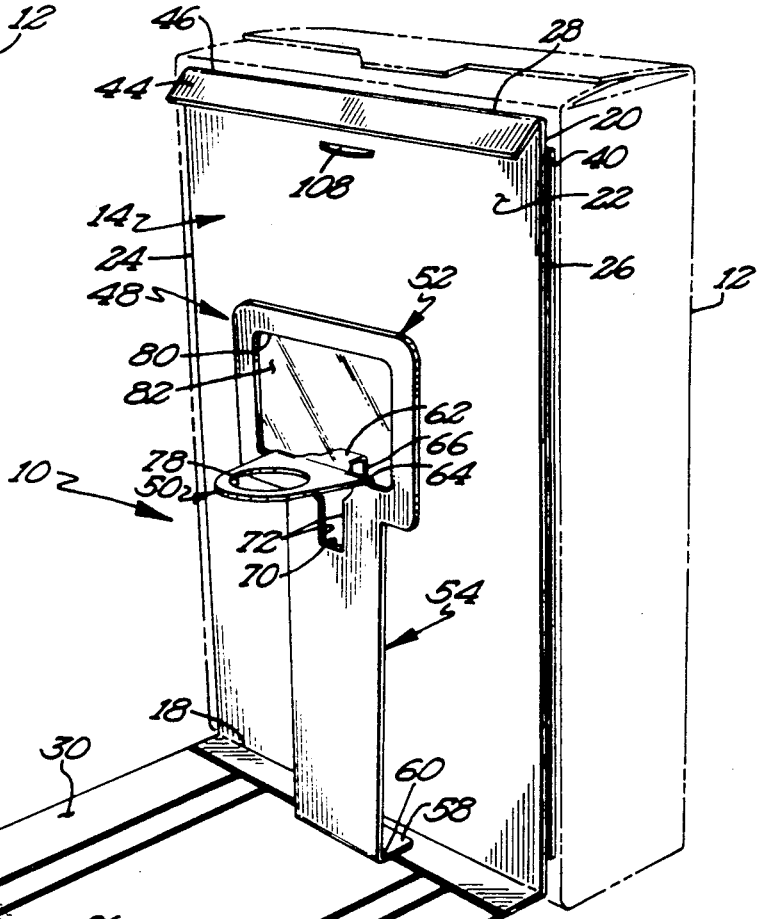
FIG. 2 shows a perspective view of the game of FIG. 1 in a playing position, with the box again shown in phantom.
Figure 2:
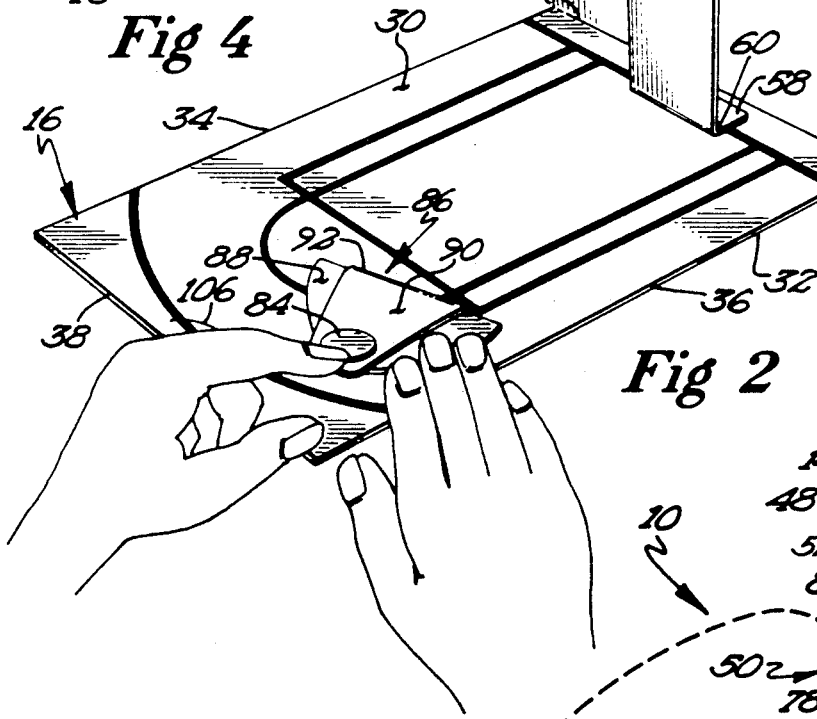
Figure 6:
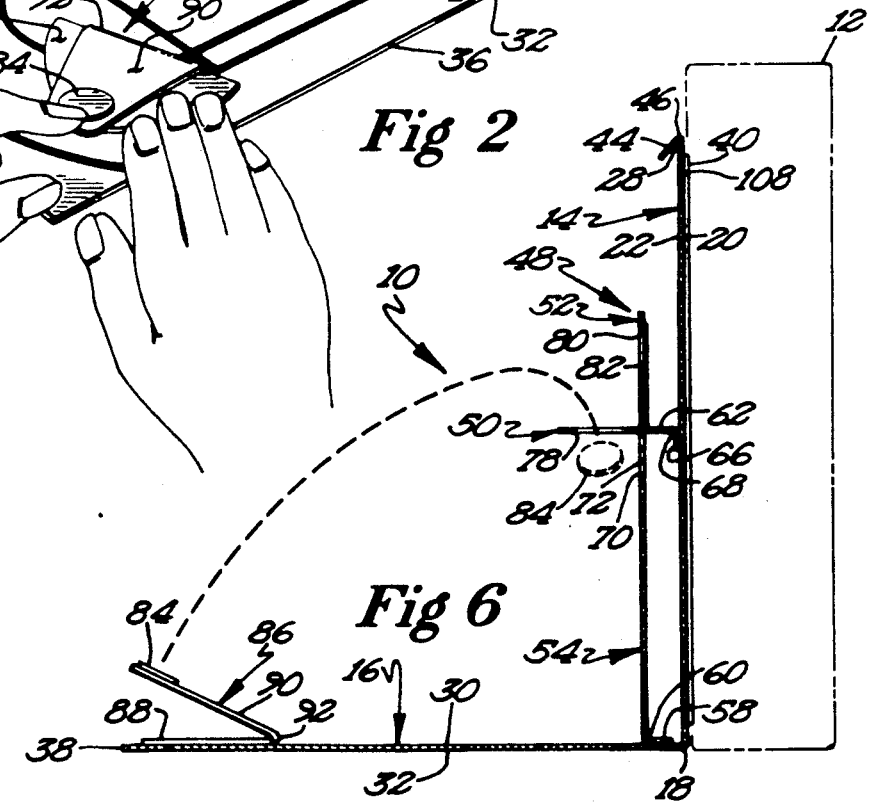
FIG. 6 shows a cross-sectional view of the game of FIG. 1 in the position of FIG. 2, with the path of an impelled game piece being shown in phantom.
Figure 3:
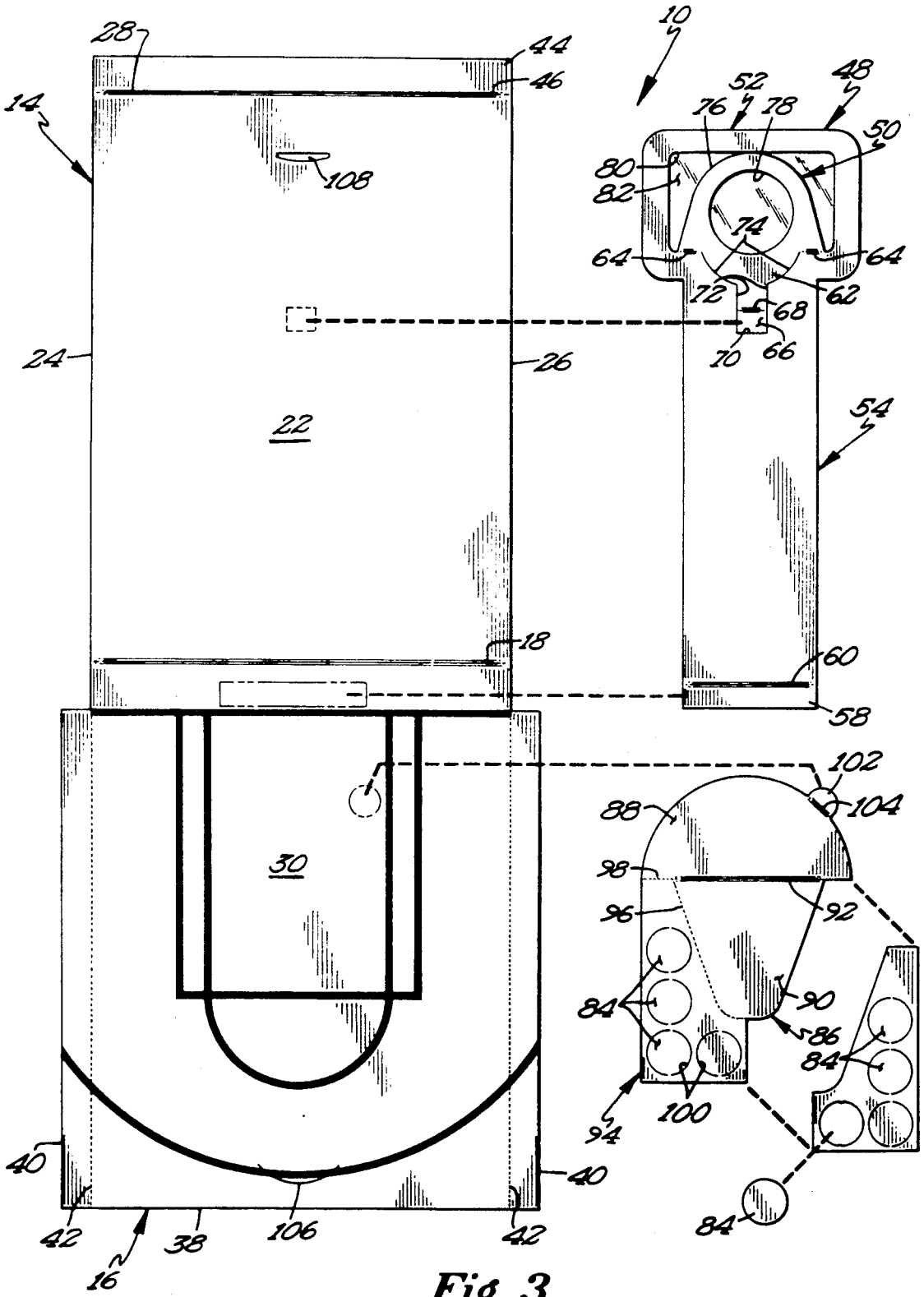
FIG. 3 shows flat layouts of the components of the game of FIG. 1, with securement locations being shown in exploded form.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "front", "rear", "side", "back", "face", and similar terms are used herein, it should be understood that these terms have reference only to the structure shown in the drawings as it would appear to a person viewing the drawings and are utilized only to facilitate describing the invention.

DESCRIPTION

A collapsible game according to the most preferred form of the present invention is shown in the drawings as a basketball game and generally designated 10. Game 10 is intended to be fastened or secured to and supported by the back of a cereal box or like product 12 such that game 10 comprises a promotional device for the sale of the cereal located in box 12.

Specifically, game 10 includes first and second panels 14 and 16 which are pivotal about a panel axis and particularly are hingedly connected together along a bottom edge 18. In the most preferred form, panels 14 and 16 are integrally formed from a sheet of paper material having a thinness requiring external support. Panel 14 includes bottom edge 18, a rear face 20, a front face 22, first and second, parallel side edges 24 and 26 extending generally perpendicular from edge 18, and a top edge 28 generally parallel to but spaced from edge 18. Similarly, panel 16 includes bottom edge 18, a first face 30, a second face 32, first and second, parallel side edges 34 and 36 extending generally perpendicular from edge 18, and a top edge 38 generally parallel to but spaced from edge 18. In the most preferred form, the spacing between edges 24 and 26 is equal to the spacing between edges 34 and 36, with edges 24 and 34 and edges 26 and 36 being contiguous. The spacing between edges 18 and 28 is generally equal to but slightly greater than the spacing between edges 18 and 38.

Panel 16 further includes side flaps 40 integrally formed with and hingedly secured to edges 34 and 36 and extending from perforated fold lines 42 which define edges 34 and 36. Panel 14 further includes a top flap 44 integrally formed with and hingedly secured to edge 28 and extending from a fold line 46 which in the preferred form is also perforated and which defines top edge 28. Top flap 44 has a height greater than the difference in spacing between edges 18 and 28 and between edges 18 and 38.

Game 10 further includes a movable structure 48 which in the preferred form is a goal and in the most preferred form is a basketball goal or hoop portion 50 and backboard portion 52 supported by a stand portion 54. In the preferred form, hoop portion 50, backboard portion 52 and stand portion 54 are integrally formed of a paperboard of a stiffness not requiring external support. Stand portion 54 is pivotally connected to a hinge portion 58 about a fold line 60 defining a structure axis for pivotally mounting stand portion 54 to panel 16. Hinge portion 58 is secured by any suitable means such as adhesive to first face 30 with fold line 60 parallel to and spaced from edge 18. A spacer portion 62 is pivotally connected to stand portion 54 about a fold line 64 defining a portion axis which is parallel to and spaced from fold line 60. Spacer portion 62 is pivotally connected to a hinge portion 66 about a fold line 68 which defines a further structure axis for pivotally mounting spacer portion 62 to panel 14 and which is parallel to fold line 64 and spaced therefrom a distance generally equal to the spacing of fold line 60 from edge 18. Hinge portion 66 is secured by any suitable means such as adhesive to front face 22 with fold line 68 parallel to and spaced from edge 18, with the spacing between fold line 68 and edge 18 being generally equal to the spacing between fold lines 60 and 64.

In the preferred form, hoop portion 50 is pivotally connected to stand portion 54 about fold line 64 and in the most preferred form is integral and contiguous with spacer portion 62. Particularly, stand portion 54 includes a first die cut 70 located between and parallel to fold lines 60 and 64. Second, side die cuts 72 extend from the opposite ends of die cut 70 generally perpendicular thereto in the preferred form towards but spaced from fold line 64. Third, arcuate die cuts 74 extend from die cuts 72 to fold line 64. Hinge portion 66 is formed by and defined by die cuts 70 and 72 and spacer portion 62 is formed by and defined by die cuts 72 and 74. Backboard portion 52 includes a fourth generally parabolic die cut 76 having free ends located on fold line 64 spaced from die cuts 74. A circular hoop opening 78 is provided generally concentric to and within die cuts 74 and 76, with fold line 64 being generally tangential to opening 78. A rectangular opening 80 is formed in backboard portion 52 by a top die cut which is generally parallel to and spaced from fold line 64 and side die cuts extending between the ends of the top die cut and fold line 64 and the free ends of die cut 76. It can then be appreciated that goal 48 is integrally formed from a single, planar blank by die cutting thereof. Opening 80 is closed by a translucent, thin membrane 82 secured to the back face of backboard portion 52 around opening 80.

Game 10 further includes a game piece 84 shown in the preferred form as a basketball 84 which in the most preferred form is a paperboard disc. Game 10 further includes a device 86 for impelling game piece 84 towards goal 48. In the most preferred form, device 86 includes a base 88 and a paddle like lever 90 pivotally and integrally connected to base 88 about a fold line 92. In the preferred form, pieces 84 and device 86 are formed from the same blank 94. Specifically, lever 90 is formed by an interior parabolic die cut 96 having free ends located on fold line 92. Perforations 98 extend from the free ends of die cut 96 contiguous with and extending outwardly from fold line 92 to the edges of blank 94. A multiplicity of game pieces 84 are formed by and defined by a plurality of circular perforations 100 in blank 94 outside of die cut 96 and base 88. An attachment tab 102 is secured to base 88 by a perforated line 104. Tab 102 can be secured by any suitable means such as adhesive to first face 30 at a location spaced from edge 18 and from portion 58 to releasably hold blank 94 including device 86 to panel 16. Securement of blank 94 to panel 16 prevents misplacement of blank 94 during manufacture and assembly of game 10.

Panel 16 includes an integral tab 106 formed by an arcuate die cut through panel 16. Panel 14 includes a slot 108 formed by die cutting through panel 14. Slot 108 is located complementary to and for slidably receiving tab 106.

It should be noted that face 22 of panel 14 and faces 30 and 32 of panel 16 include suitable printed material according to the theme of game 10. For example, face 22 could include pictures of typical players of the game theme against a backdrop of spectators of that game, face 30 could include the typical markings of the playing field or floor of the game theme, and face 32 could include instructions, advertisements, and the like for game 10.

Now that the construction of the preferred form of game 10 has been set forth, the assembly and play of game 10 can be set forth according to the preferred teachings. Specifically, after portion 58 has been adhered to panel 16, portion 66 has been adhered to panel 14, and attachment tab 102 has been adhered to panel 16, panels 14 and 16 can be pivoted about edge 18 with faces 22 and 30 in a first, abutting position with front face 22 of panel 14 abutting with first face 30 of panel 16 and with goal 48 in a first, flat condition and with blank 94 sandwiched therebetween. It should be noted that due to the parallel nature of fold lines 60, 64, and 68 to edge 18, goal 48 also folds into its first, flat, planar condition as panels 14 and 16 are pivoted about edge 18 to the first, abutting position. With panels 14 and 16 in an abutting relation, side flaps 40 of panel 16 are secured to rear face 20 of panel 14 such as by adhesive to hold panels 14 and 16 in the first position. Similarly, top flap 44 of panel 14 is secured to face 32 of panel 16 to retain panels 14 and 16 in the first position. In the most preferred form, top flap 44 is secured to face 32 of panel 16 to allow flap 44 to be manually lifted from panel 16 and pivoted about fold line 46 and particularly in the preferred form is secured at a multiplicity of spaced locations. It can then be appreciated that game 10 is in a collapsed, one piece condition with panels 14 and 16 and flaps 40 and 44 enclosing the interior components of game 10.

With game 10 in its collapsed, one piece condition, rear face 20 can be secured to a separately assembled box 12 which can be assembled in any manner. Face 20 should be secured in a manner to allow later insertion of tab 106 into slot 108 and in the preferred form is secured by parallel strips of adhesive located outwardly of slot 108. It should be noted that box 12 provides the external support for panel 14 and game 10. With game 10 secured to box 12, box 12 can be retailed in the normal manner.

After purchase, the consumer can open game 10 by releasing panels 14 and 16 from the first position. Specifically, top flap 44 can be manually lifted from panel 16 to break the adhesive securement therebetween and release panels 14 and 16. Top flap 44 can be removed, if desired, by tearing along perforated fold line 46. Panel 16 is further released by tearing perforated fold lines 42 separating side flaps 40 adhered to panel 14 from panel 16. It can then be appreciated that after release, panel 16 is able to pivot about edge 18 from the first position to a second position extending at an angle to and in the preferred form generally perpendicular from face 22 of panel 14, with panel 16 being supported by the table top or other support surface upon which box 12 is supported. It can also be appreciated that as panel 16 pivots relative to panel 14 from the first position to the second position, goal 48 simultaneously pivots relative to panels 14 and 16 about fold lines 60, 64, and 68 from its first, flat condition to a second condition with goal 48 being three dimensionally spaced from panels 14 and 16. When panel 16 is generally perpendicular to panel 14, backboard portion 52 and stand portion 54 are generally parallel to and spaced from front face 22 of panel 14 and are generally perpendicular to first face 30 of panel 16, and hoop portion 50 and spacer portion 62 are generally parallel to and spaced from first face 30 of panel 16 and are generally perpendicular to front face 22 of panel 14.

Blank 94 can be released from panel 16 such as by tearing perforated line 104 to remove attachment tab 102 adhered to panel 16. If desired, attachment tab 102 can be removed from panel 16 by breaking the adhesive securement therebetween. Game pieces 84 can be removed from blank 94 by tearing perforations 100. If desired, base 88 and lever 90 can be removed from blank 94 by tearing perforations 98.

To impel game pieces 84, base 88 is positioned at the desired location on face 30 of panel 16 and held stationary thereon by the consumer's first hand. Lever 90 can be pivoted about fold line 92 to a state generally overlying base 88. Due to the integral nature of lever 90 with base 88, lever 90 is placed under a tension force acting to return to a flat, in line, planar state extending in a straight manner from base 88. After game piece 84 is located on lever 90 opposite to base 88 with lever 90 overlying base 88, lever 90 and game piece 84 located thereon can be released such that lever 90 will move under the tension force to its in line position. As game piece 84 is not secured to lever 90, movement of lever 90 will propel or impel game piece 84 towards goal 48. The object of game 10 according to the preferred form of the present invention is to position impelling device 86 on panel 16 and to pivot lever 90 relative to base 88 such that game piece 84 is impelled to pass through hoop portion 50.

After play of game 10 has been completed, impelling device 86 in its flat state and game pieces 84 can be positioned on panel 16, and panel 16 can be pivoted to abut with panel 14 in the first position. It can be appreciated that as panel 16 pivots relative to panel 14 from the second position to the first position, goal 48 simultaneously pivots relative to panels 14 and 16 from the second condition into the first condition when panel 16 abuts with panel 14. To removably fasten panel 16 in the first position, tab 106 can be pivoted to extend beyond face 30 of panel 16 and into and for capture within slot 108 of panel 14. It can then be appreciated that the thinness and minimal structural strength of panel 16 allows tab 106 to be easily pivoted without requiring fold lines, hinges, or the like.

It can be appreciated that the design of game 10 according to the preferred teachings of the present invention is believed to be particularly advantageous. Specifically, game 10 is formed separate from and secured to box 12. Thus, box 12 can be formed utilizing standard techniques. Furthermore, it can be appreciated that the back of box 12 can include printing so that game 10 can be secured to selected boxes 12 or selected production of boxes 12 as desired, with game 10 secured to boxes 12 covering part or all of the printing on the back of box 12. Additionally, panels 14 and 16 can be formed of lightweight, less expensive material to economically allow the separate formation of game 10 from box 12. It should be again appreciated that game 10 relies upon box 12 and the support surface such as a table where box 12 is placed for its structural strength which then allows panels 14 and 16 to be formed of thin material having little structural strength.

Further, due to the securement of side flaps 40 and top flap 44 and the integral edge 18 of panels 14 and 16, game 10 does not include any free edges which are subject to accidental catching in its collapsed, one piece condition. Thus, box 12 including game 10 secured thereto can be handled in the normal manner in the placement of boxes 12 in cartons for shipment and storage and in the retail of boxes 12 without fear of tearing or ripping game 10. Furthermore, the securement of goal 48 to panels 14 and 16 and the securement of attachment tab 102 of blank 94 prevents shifting of goal 48 and blank 94 between panels 14 and 16 during assembly, shipment and storage.

Furthermore, the design of goal 48 is believed to be advantageous. Particularly, due to the stiffness of goal 48, goal 48 is of a sufficient rigidity to maintain its shape without external support, with panels 14 and 16 only holding goal 48 in an upright position. Thus, goal 48 can be positioned forward of and parallel to panel 14 to three dimensionally space and expose goal 48 from panels 14 and 16 and box 12. Additionally, due to the preferred arrangement of goal 48, hoop portion 50, hinge portion 66, and spacer portion 62 are integral and can be die cut from the interior of backboard portion 52 and stand portion 54. Furthermore, due to the pivotal arrangement, hoop portion 50, hinge portions 58 and 66, and spacer portion 62 are pivotal into a single plane with no components overlying to minimize the thickness of goal 48 in the folded state and thus to minimize the spacing required between panels 14 and 16 in their abutting relation and the thickness of game 10 in its folded-up condition. Additionally, rectangular opening 80 and translucent membrane 82 allow viewing of face 22 of panel 14 therethrough and give backboard portion 52 an appearance similar to actual backboards in use.

Further, tab 106 and slot 108 are believed to be advantageous. Particularly, tab 106 received within slot 108 retains game 10 in its folded condition when game 10 is not in use. Thus, game 10 can be stored within minimal space. This is especially important as box 12 including game 10 secured thereto can be handled by the consumer as boxes 12 would be normally handled without games 10 secured thereto during storage of boxes 12 or during transport of boxes 12 from their storage location to their consumption location such as a table and without panels 14 and 16 pivoting relative to each other. Additionally, tab 106 and slot 108 can be inexpensively die cut in panels 14 and 16 and thus are integral with panels 14 and 16 and specifically are not separate pieces requiring assembly to panels 14 and 16.

Top flap 44 can be retained on panel 14 after the securement with panel 16 has been broken or can be removed from panel 14 by tearing fold line 46, as desired. The increased length of panel 14 than that of panel 16 allows face 22 of panel 14 located above panel 16 in its abutting relation to have the appearance of the front face of top flap 44. Thus, game 10 will have the same general appearance if top flap 44 is retained or removed from game 10.

It should be noted that in the one-piece condition, panels 14 and 16 are releasably held in the first, abutting positions by side flaps 40 and top flap 44 which are integrally formed with panels 14 and 16 free of separate components which require additional expense and assembly. Further, after release of flaps 40 and 44, panels 14 and 16 are releasably held and removably fastened by tab 106 and slot 108 which are also integrally formed with panels 14 and 16 free of separate components which require additional expense and assembly.

Now that the basic teachings of the present invention have been explained, many extensions and variations will be obvious to one having ordinary skill in the art. For example, although game 10 is shown in the preferred form as a basketball game, game 10 may be of other types with goal 48 being football goal posts and impelling device 86 launching game pieces 84 in the shape of footballs through the uprights, with goal 48 being net type goals and impelling device 86 launching game pieces 84 in the shape of hockey pucks or soccer balls, or the like.

Likewise, although game 10 is shown in the preferred form with panels 14 and 16 formed of thin paper material and is believed to be particularly advantageous for the reasons set forth previously, panels 14 and 16 could be formed of material having greater structural strength. Panels 14 and 16 of greater structural strength would not achieve all of the advantages of the preferred form of the present invention but would obtain other advantages such as the ability to die cut movable structure 48 from panels 14 and 16 with movable structure 48 being integrally formed and pivotally mounted to panels 14 and 16.

Thus since the invention disclosed herein may be embodied in other specific forms without departing from the spirit of general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A promotional device for securement to a product, comprising, in combination: a first panel having a rear face, a front face, a bottom edge, a top edge, and side edges; a second panel having a first face, a second face, a bottom edge, a top edge, and side edges, with the first and second panels being pivotal about a panel axis between a first position with the front face of the first panel abutting with the first face of the second panel and a second position with the first face of the second panel extending at an angle from the front face of the first panel, with the panel axis located along and parallel to at least one of said top edges, bottom edges and side edges of said first panel and said second panel; means for securing the rear face of the first panel to the product with the product providing external support to the first panel; a movable structure to the first and second panels for simultaneous pivotal movement relative to the first and second panels between a first, flat condition intermediate the first and second panels in the first position and a second condition with the movable structure being three dimensionally spaced from the first and second panels in the second position; and means for releasably holding the first and second panels in the first position, with the releasably holding means being integrally formed with the first and second panels.

2. The promotional device of claim 1 wherein the bottom edges of the first and second panels are integral.

3. A promotional device comprising, in combination: a first panel having a rear face, a front face, a bottom edge, a top edge, and side edges; a second panel having a first face, a second face, a bottom edge, a top edge, and side edges, with the first and second panels being pivotal about a panel axis between a first position with the front face of the first panel abutting with the first face of the second panel and a second position with the first face of the second panel extending at an angle from the front face of the first panel, with the panel axis located along and parallel to at least one of said top edges, bottom edges and side edges of said first panel and said second panel; a movable structure; means for pivotally mounting the movable structure to the first and second panels for simultaneous pivotal movement relative to the first and second panels between a first, flat condition intermediate the first and second panels in the first position and a second condition with the movable structure being three dimensionally spaced for the first and second panels in the second position; and means for releasably holding the first and second panels in the first position, with the releasably holding means being integrally formed with the first and second panels wherein the releasably holding means comprises side flaps hingedly secured to the side edges of the second panel along perforated fold lines, with the side flaps being adhered to the rear face of the first panel, with the second panel being releasable from the first panel by tearing the perforated fold lines of the side flaps.

4. The promotional device of claim 3 wherein the releasably holding means further comprises, in combination: a top flap hingedly secured to the top edge of the first panel along a fold line, with the top flap being adherable to the second face of the second panel, with the second panel being releasable from the first panel by breaking the adherance of the top flap to the second panel.

5. A promotional device comprising, in combination: a first panel having a rear face, a front face, a bottom edge, a top edge, and side edges; a second panel having a first face, a second face, a bottom edge, a top edge, and side edges, with the first and second panels being pivotal about a panel axis between a first position with the front face of the first panel abutting with the first face of the second panel and a second position with the first face of the second panel extending at an angle from the front face of the first panel, with the panel axis located along and parallel to at least one of said top edges, bottom edges and side edges of said first panel and said second panel; a movable structure; means for pivotally mounting the movable structure to the first and second panels for simultaneous pivotal movement relative to the first and second panels between a first, flat condition intermediate the first and second panels in the first position and a second condition with the movable structure being three dimensionally spaced from the first and second panels in the second position; and means for releasably holding the first and second panel in the first position, with the releasably holding means being integrally formed with the first and second panels, wherein the releasably holding means comprises, in combination: a top flap hingedly secured to the top edge of the first panel along a fold line, with the top flap being adherable to the second face of the second panel, with the second panel being releasable from the first panel by breaking the adherance of the top flap to the second panel, wherein the fold line of the top flap is perforated allowing the top flap to be torn from the first panel.

6. The promotional device of claim 3 wherein the releasably holding means comprises means for removably fastening the first and second panels in the first position.

7. The promotional device of claim 6 wherein the removably fastening means comprises, in combination: a slot die cut in the first panel; and a tab die cut in the second panel, with the tap being pivotal past the first face of the second panel for removable, slideable receipt in the slot of the first panel.

8. The promotional device of claim 1 wherein the releasably holding means comprises means for removably fastening the first and second panels in the first position.

9. The promotional device of claim 8 wherein the removably fastening means comprises, in combination: a slot die cut in the first panel; and a tab die cut in the second panel, with the tab being pivotal past the first face of the second panel for removable, slideable receipt in the slot of the first panel.

10. The promotional device of claim 1 wherein the movable structure includes at least a first portion pivotally connected to a second portion about a portion axis; and wherein the pivotally mounting means comprises, in combination: means for pivotally mounting the first portion to the first panel about a first structure axis parallel to and spaced from both the panel axis and the portion axis; and means for pivotally mounting the second portion to the second panel about a second structure axis parallel to and spaced from both the panel axis and the portion axis.

11. A promotional device comprising, in combination: a first panel having a rear face, a front face, a bottom edge, a top edge, and side edges; a second panel having a first face, a second face, a bottom edge, a top edge, and side edges, with the first and second panels being pivotal about a panel axis between a first position with the front face of the first panel abutting with the first face of the second panel and a second position with the first face of the second panel extending at an angle from the front face of the first panel, with the panel axis located along and parallel to at least one of said top edges, bottom edges and side edges of said first panel and said second panel; a movable structure including at least a first portion pivotally connected to a second portion about a portion axis, wherein the first portion is integral with the second portion and formed by die cutting the second portion; and means for pivotally mounting the movable structure to the first and second panels for simultaneous pivotal movement relative to the first and second panels between a first, flat condition intermediate the first and second panels in the first position and a second condition with the movable structure being three dimensionally spaced from the first and second panels in the second position, wherein the pivotally mounting means comprises, in combination: means for pivotally mounting the first portion to the first panel about a first structure axis parallel to and spaced from both the panel axis and the portion axis; and means for pivotally mounting the second portion to the second panel about a second structure axis parallel to and spaced from both the panel axis and the portion axis, with the first portion extending from the portion axis towards the first structure axis, with the first portion being planar with the second portion in the first condition.

12. The promotional device of claim 11 wherein the movable structure further includes a third portion integral with the first portion and extending on the opposite side of the portion axis from which the first portion extends.

13. The promotional device of claim 12 wherein the movable structure further includes a fourth portion integral with the second portion and extending on the opposite side of the portion axis from which the second portion extends with the third portion being formed by die cuts in the fourth portion, with the third portion being planar with the fourth portion in the first condition.

14. The promotional device of claim 13 wherein the movable structure further includes a thin membrane secured to the fourth portion and extending over the die cuts in the fourth portion which form the third portion; wherein the third portion is in the form of a hoop, with the fourth portion and membrane forming a backboard for the hoop.

15. A promotional device comprising, in combination: a first panel having a rear face, a front face, a bottom edge, a top edge, and side edges; a second panel having a first face, a second face, a bottom edge, a top edge, and side edges, with the first and second panels being pivotal about a panel axis between a first position with the front face of the first panel abutting with the first face of the second panel and a second position with the first face of the second panel extending at an angle from the front face of the first panel, with the panel axis located along and parallel to at least one of said top edges, bottom edges and side edges of said first panel and said second panel; a movable structure comprising a goal; means for pivotally mounting the movable structure to the first and second panels for simultaneous pivotal movement relative to the first and second panels between a first, flat condition intermediate the first and second panels in the first position and a second condition with the movable structure being three dimensionally spaced from the first and second panels in the second position; and at least a first game piece; and means for impelling the game piece toward the goal.

16. The promotional device of claim 15 wherein the impelling means comprises, in combination: a base; and a lever integrally formed with and extending from the base along a fold line, with the lever movable from a first, flat state extending in a straight manner from the base for positioning between the first and second panels in the first position and a second state extending in an overlying manner over the base, with the lever being biased to move from the second state to the first state to provide impelling force to the game piece.

17. The promotional device of claim 16 further comprising, in combination: means for releasably holding the impelling means to the second panel.

18. The promotional device of claim 17 wherein the impelling means releasably holding means comprises an attachment tab integrally formed with the base along a perforated tear line, with the attachment tab being adherable to the second panel, with the impelling means being releasable from the second panel by tearing the attachment tab from the base.

19. A collapsible game comprising, in combination: a first panel having a front face; a second panel having a first face, with the first and second panels being pivotal about a panel axis between a first position with the front face of the first panel abutting with the first face of the second panel and a second position with the first face of the second panel extending at an angle from the front face of the first panel; and a goal comprising, in combination: a stand portion pivotally connected to a spacer portion about a portion axis; means for pivotally mounting the stand portion to the second panel about a stand axis with the stand axis being parallel to and spaced from both the panel axis and the portion axis; means for pivotally mounting the spacer portion to the first panel about a spacer axis with the spacer axis being parallel to and spaced from each of the panel axis, the portion axis, and the stand axis, with the goal being simultaneously pivotal relative to the first and second panels between a first, flat condition intermediate the first and second panels in the first position and a second condition with the goal being three dimensionally spaced from the first and second panels in the second position, wherein the spacer portion is integral with the stand portion and formed by die cutting the stand portion, with the spacer portion extending from the portion axis towards the stand axis, with the spacer portion being planar with the stand portion in the first condition; and a goal portion integral with the spacer portion and extending on the opposite side of the portion axis from which the spacer portion extends.

20. The collapsible game of claim 19 wherein the goal further comprises, in combination: a further portion integral with the stand portion and extending on the opposite side of the portion axis from which the stand portion extends, with the goal portion formed by die cuts in the further portion, with the goal portion being planar with the fourth portion in the first condition.

21. The collapsible game of claim 20 wherein the goal portion is in the form of a hoop; and wherein the goal further comprises, in combination: a thin membrane secured to the further portion and extending over the die cuts in the further portion forming the goal portion, with the further portion and the thin membrane forming a backboard for the hoop.

22. The collapsible game of claim 21 wherein the thin membrane is translucent to allow viewing the front face of the first panel therethrough.

23. The collapsible game of claim 19 including a device for impelling a game piece comprising, in combination: a base; and a lever integrally formed with and extending from the base along a fold line, with the lever movable from a first, flat state extending in a straight manner from the base and a second state extending in an overlying manner over the base, with the lever being biased to move from the second state to the first state to provide an impelling force to the game piece.

* * * * *

UNITED STATES PATENT AND TRADEMARK OFFICE

CERTIFICATE OF CORRECTION

PATENT NO. : 5,104,124

DATED : April 14, 1992

INVENTOR(S) : Stuart N. Bernard, Sanford K. Otsuji, David J. Rosendale

It is certified that error appears in the above-identified patent and that said Letters Patent is hereby corrected as shown below:

Col. 8, line 39; "movable structure to" should be -- movable structure; means for pivotally mounting the movable structure to -- ;

Col. 11, line 34; "provide impelling" should be -- provide an impelling -- ;

Col. 12, line 28 ; "portion formed" should be -- portion being formed -- .

Signed and Sealed this

Fifteenth Day of June, 1993

*Attest:*

*Attesting Officer*

Michael K. Kirk

MICHAEL K. KIRK

*Acting Commissioner of Patents and Trademarks*